US009570023B2

(12) United States Patent
Jeong et al.

(10) Patent No.: US 9,570,023 B2
(45) **Date of Patent: *Feb. 14, 2017**

(54) DISPLAY PANEL HAVING A BOOSTING VOLTAGE APPLIED TO A SUBPIXEL ELECTRODE, AND METHOD OF DRIVING THE SAME

(71) Applicant: Samsung Display Co., Ltd., Yongin-si (KR)

(72) Inventors: Youn-Hak Jeong, Cheonan-si (KR); Gak-Seok Lee, Busan (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/077,448

(22) Filed: Mar. 22, 2016

(65) Prior Publication Data

US 2016/0203781 A1 Jul. 14, 2016

Related U.S. Application Data

(63) Continuation of application No. 13/586,356, filed on Aug. 15, 2012, now Pat. No. 9,318,066.

(30) Foreign Application Priority Data

Jan. 18, 2012 (KR) ..... 10-2012-0005672

(51) Int. Cl.
*G09G 3/36* (2006.01)

(52) U.S. Cl.
CPC ..... *G09G 3/3659* (2013.01); *G09G 3/3607* (2013.01); *G09G 3/3696* (2013.01);
(Continued)

(58) Field of Classification Search
CPC .. G09G 3/3659; G09G 3/3607; G09G 3/3614; G09G 3/3696; G09G 2320/0646; G09G 2320/0242; G09G 2320/0673; G09G 2300/0809; G09G 2300/0447; G09G 2340/16; G09G 2320/0252
See application file for complete search history.

(56) References Cited

U.S. PATENT DOCUMENTS 8,081,263 B2 * 12/2011 You ..... G02F 1/13624 349/38
9,318,066 B2 * 4/2016 Jeong ..... G09G 3/3659
(Continued)

FOREIGN PATENT DOCUMENTS

JP WO 2010143612 A1 * 12/2010 ..... G09G 3/3648
KR 0658063 12/2006
(Continued)

OTHER PUBLICATIONS

Non-Final Office Action issued May 2, 2014, in U.S. Appl. No. 13/586,356.
(Continued)

*Primary Examiner* — Dwayne Bost
*Assistant Examiner* — Ivelisse Martinez Quiles
(74) *Attorney, Agent, or Firm* — H.C. Park & Associates, PLC

(57) ABSTRACT

A display panel including a plurality of pixels. A first pixel among the plurality of pixels includes a first subpixel, which further includes a first subpixel electrode, a first switching element configured to apply a data voltage to the first subpixel electrode, and a second switching element applying a boosting voltage to the first subpixel electrode. The first pixel further includes a second subpixel including a second subpixel electrode and a third switching element applying the data voltage to the low pixel electrode. Accordingly, display quality and reliability of the display panel may be improved.

20 Claims, 8 Drawing Sheets

(52) U.S. Cl.
CPC ... *G09G 3/3614* (2013.01); *G09G 2300/0447* (2013.01); *G09G 2300/0809* (2013.01); *G09G 2320/0242* (2013.01); *G09G 2320/0252* (2013.01); *G09G 2320/0646* (2013.01); *G09G 2320/0673* (2013.01); *G09G 2340/16* (2013.01)

(56) References Cited

U.S. PATENT DOCUMENTS

2005/0122441 A1 6/2005 Shimoshikiryoh
2008/0303809 A1* 12/2008 Lee ..... G09G 3/3648 345/215
2009/0256985 A1* 10/2009 Jung ..... G02F 1/1368 349/48
2009/0295703 A1* 12/2009 Hsieh ..... G09G 3/3659 345/94
2009/0322798 A1 12/2009 Lin et al.
2010/0123702 A1* 5/2010 Kim ..... G09G 3/3614 345/211
2010/0157185 A1* 6/2010 Kim ..... G02F 1/1362 349/38
2010/0328290 A1 12/2010 Jeong et al.
2012/0013596 A1* 1/2012 Kim ..... G09G 3/3413 345/212
2012/0081345 A1* 4/2012 Yamauchi ..... G09G 3/3648 345/209
2012/0105785 A1* 5/2012 Kim ..... G09G 3/3648 349/139
2012/0236245 A1* 9/2012 Jung ..... G02F 1/134336 349/144
2012/0242711 A1* 9/2012 Choi ..... G09G 3/3607 345/690

FOREIGN PATENT DOCUMENTS

KR 1020080062542 7/2008
KR 2010042359 4/2010
WO 2010143612 12/2010

OTHER PUBLICATIONS

Final Office Action issued Nov. 21, 2014, in U.S. Appl. No. 13/586,356.
Non-Final Office Action issued Apr. 20, 2015, in U.S. Appl. No. 13/586,356.
Final Office Action issues Sep. 21, 2015, in U.S. Appl. No. 13/586,356.
Notice of Allowance mailed Dec. 7, 2015, in U.S. Appl. No. 13/586,356.

* cited by examiner

DISPLAY PANEL HAVING A BOOSTING VOLTAGE APPLIED TO A SUBPIXEL ELECTRODE, AND METHOD OF DRIVING THE SAME

CROSS-REFERENCE TO RELATED APPLICATION

This application is a Continuation of U.S. patent application Ser. No. 13/586,356, filed on Aug. 15, 2012, now U.S. Pat. No. 9,318,066 B2, and claims priority from and the benefit of Korean Patent Application No. 10-2012-0005672, filed on Jan. 18, 2012, both of which are hereby incorporated by reference for all purposes as if fully set forth herein.

BACKGROUND OF THE INVENTION

Field of the Invention

Exemplary embodiments of the present invention relate to a display panel and a method of driving the display panel. More particularly, exemplary embodiments of the present invention relate to a display panel improving the display quality and reliability and a method of driving the display panel.

Discussion of the Background

Generally, a liquid crystal display ("LCD") apparatus includes a first substrate including a pixel electrode, a second substrate including a common electrode and a liquid crystal layer disposed between the first and second substrate. An electric field is generated by voltages applied to the pixel electrode and the common electrode. By adjusting an intensity of the electric field, a transmittance of a light passing through the liquid crystal layer may be adjusted so that a desired image may be displayed.

In a vertical alignment type LCD apparatus, a unit pixel of a display panel is divided into a high pixel, which has a high relative brightness, and a low pixel, which has a relatively lower brightness, to improve a side visibility.

In a conventional vertical alignment type LCD apparatus, a data voltage is applied to the high pixel and a data voltage decreased by a storage voltage is applied to the low pixel. Thus, the low pixel may not display a maximum grayscale so that a light transmittance of the display panel may decrease and a response time of the display panel may increase.

In addition, when a difference between the data voltage and the storage voltage increases, the data voltage applied to the low pixel dramatically decreases so that a light transmittance of the display panel in a high grayscale area is further decreased.

Furthermore, when the display panel is driven in a voltage inversion driving method, the single storage voltage is used for a positive polarity and a negative polarity. Due to a difference of characteristics of a switching element according to polarities, a display defect such as a flicker and an afterimage may be generated and a reliability of the switching element may decrease.

The above information disclosed in this Background section is only for enhancement of understanding of the background of the invention and therefore it may contain information that does not form any part of the prior art.

SUMMARY OF THE INVENTION

Exemplary embodiments of the present invention provide a display panel that may have an improved display quality and reliability.

Exemplary embodiments of the present invention also provide a method of driving the display panel.

Additional features of the invention will be set forth in the description which follows, and in part will be apparent from the description, or may be learned by practice of the invention.

An exemplary embodiment of the present invention discloses a display panel that includes a first pixel. The first pixel includes a high pixel including a high pixel electrode, a first switching element applying a data voltage to the high pixel electrode and a second switching element applying a boosting voltage to the high pixel electrode and a low pixel including a low pixel electrode and a third switching element applying the data voltage to the low pixel electrode.

An exemplary embodiment of the present invention discloses a method of driving a display panel. The method includes applying a data voltage to a high pixel electrode through a first switching element, applying a boosting voltage to the high pixel electrode through a second switching element and applying a data voltage to a low pixel electrode through a third switching element.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
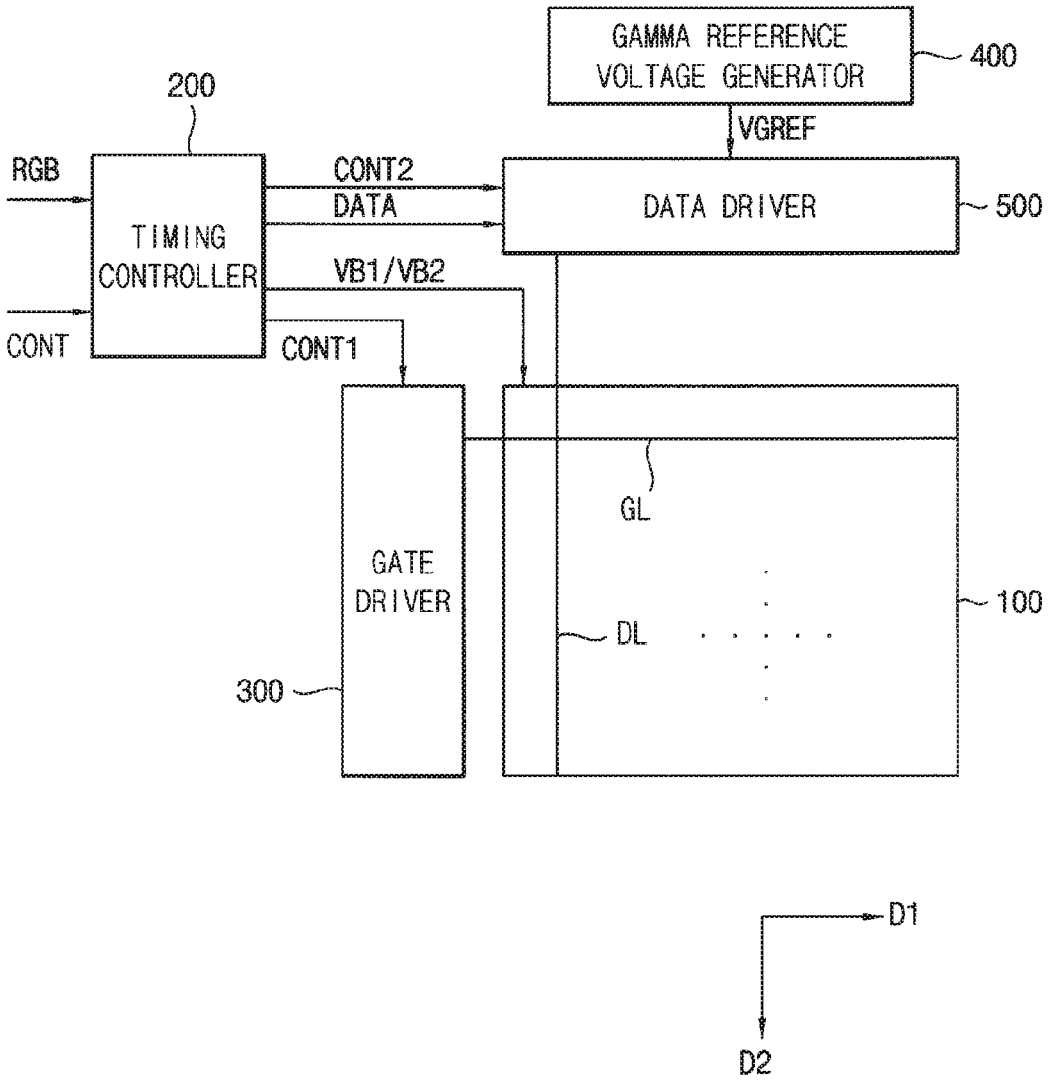
FIG. 1 is a block diagram illustrating a display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element or layer is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

FIG. 1 is a block diagram illustrating a display apparatus according to an exemplary embodiment of the present invention.

Referring to FIG. 1, the display apparatus includes a display panel 100, a timing controller 200, a gate driver 300, a gamma reference voltage generator 400, and a data driver 500.

The display panel 100 may include, for example, a first substrate including a pixel electrode, a second substrate including a common electrode and a liquid crystal layer disposed between the first and second substrates. The liquid crystal layer includes a plurality of liquid crystal molecules. The liquid crystal molecules may be vertically aligned.

For example, an absolute value of a dielectric anisotropy $\Delta\in$ of the liquid crystal molecule may be equal to or less than 4.5. For example, an elastic constant K33 of the liquid crystal molecule may be equal to or greater than 12 pico-Newtons (pN).

The display panel 100 may include a plurality of conductive lines. For example, the display panel 100 may include a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1. The pixels may be disposed in a matrix form.

Each pixel includes at least a first subpixel and a second subpixel. A structure of the pixel is explained referring to FIGS. 2 and 3 in detail.

The timing controller 200 receives input image data RGB and an input control signal CONT from an external apparatus (not shown). The input image data may include red image data R, green image data and blue image data B. The input control signal CONT includes a master clock signal and a data enable signal. The input control signal CONT may further include a vertical synchronizing signal and a horizontal synchronizing signal.

The timing controller 200 generates a first control signal CONT1, a second control signal CONT2, a data signal DATA, a first boosting voltage VB1, and a second boosting voltage VB2 based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the first boosting voltage VB1 and the second boosting voltage VB2. The timing controller outputs the first and second boosting voltages VB1 and VB2 to the display panel 100.

A structure of the timing controller 200 is explained referring to FIG. 1 in detail.

The gate driver 300 generates gate signals and supplies the gate signals to the gate lines GL in response to the first control signal CONT1 received from the timing controller 200. For example, the gate driver 300 may sequentially output the gate signals to the gate lines GL.

The gate driver 300 may have various arrangements. For example, the gate driver 300 may be directly mounted on the display panel 100, or may be connected to the display panel 100 as a tape carrier package ("TCP") type. Alternatively, the gate driver 300 may be integrated on the display panel 100.

The gamma reference voltage generator 400 generates a gamma reference voltage VGREF and provides the gamma reference voltage VGREF to the data driver 500. The gamma reference voltage VGREF has a value corresponding to a level of the data signal DATA.

The gamma reference voltage generator 400 may be disposed in the timing controller 200, separately disposed, or disposed in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The data driver 500 may have various arrangements. For example, the data driver 500 may be directly mounted on the display panel 100, or may be connected to the display panel 100 in a TCP type. Alternatively, the data driver 500 may be integrated on the display panel 100.

Figure 2:
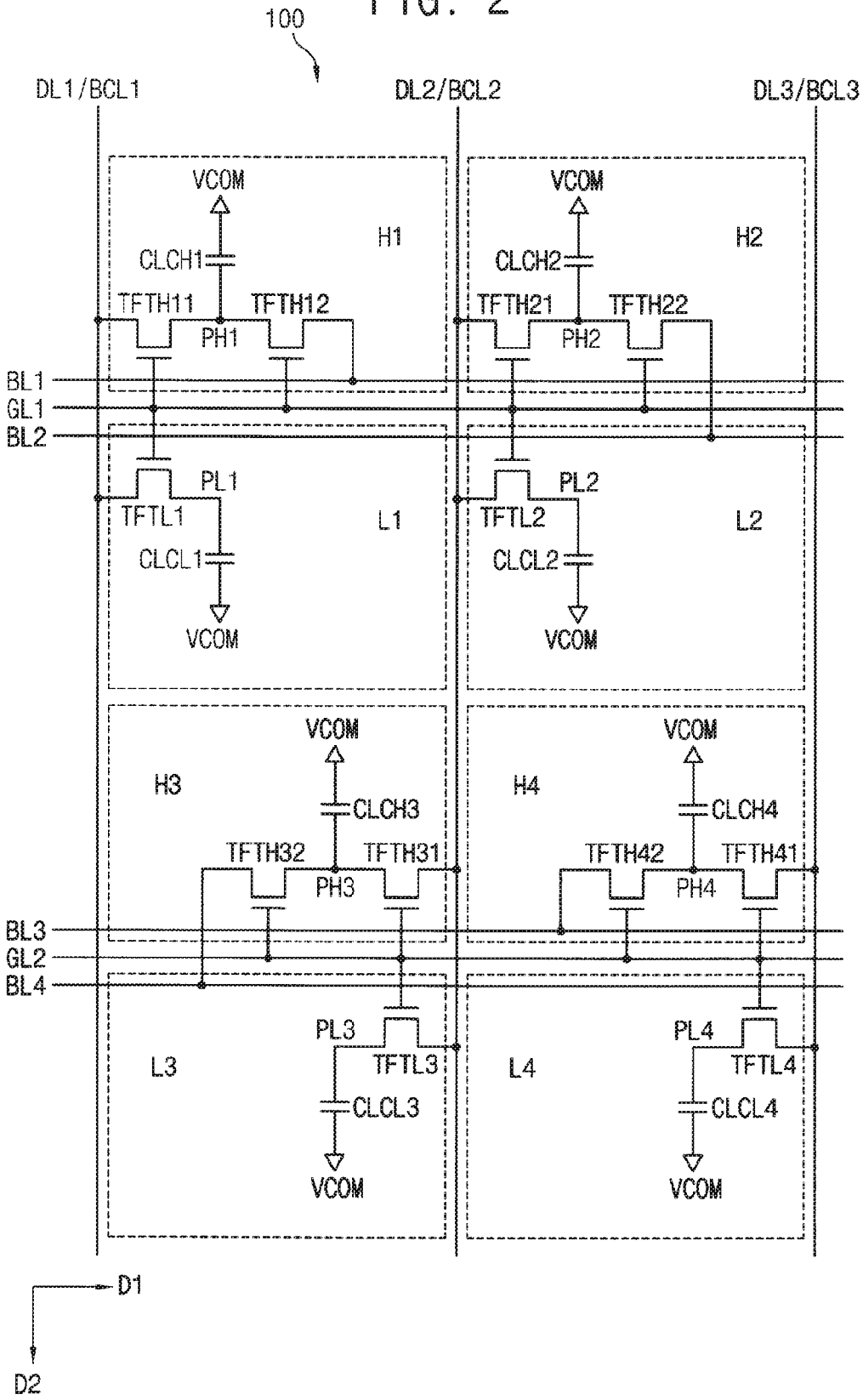
FIG. 2 is a circuit diagram illustrating a pixel structure of the display panel of FIG. 1.
Figure 3:
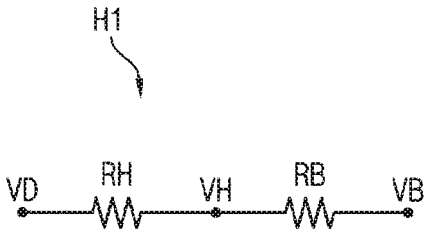
FIG. 3 is an equivalent circuit diagram illustrating a high pixel of a first pixel of FIG. 2.
Figure 4:
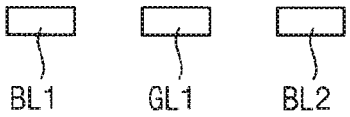
FIG. 4 is a cross-sectional view illustrating a first gate line and first and second boosting lines of FIG. 2.
Figure 5:
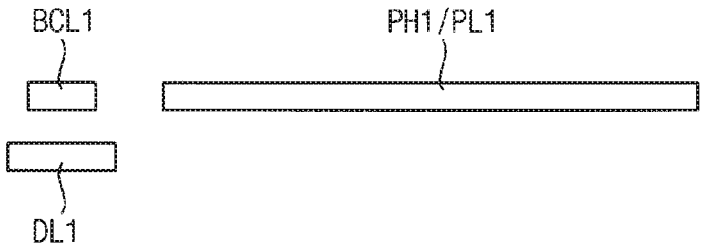
FIG. 5 is a cross-sectional view illustrating a first data line, a first boosting connecting line and high and low pixel electrodes of the first pixel of FIG. 2.

FIG. 2 is a circuit diagram illustrating a pixel structure of the display panel 100 of FIG. 1. FIG. 3 is an equivalent circuit diagram illustrating a high pixel H1 of a first pixel of FIG. 2. FIG. 4 is a cross-sectional view illustrating a first gate line GL1 and first and second boosting lines BL1 and BL2 of FIG. 2. FIG. 5 is a cross-sectional view illustrating a first data line DL1, a first boosting connecting line BCL1 and high and low pixel electrodes PH1 and PL1 of the first pixel of FIG. 2.

Although four pixels are represented in FIG. 2, FIG. 2 does not represent an entire display panel 100 but a portion of the display panel 100. The pixel structure in FIG. 2 may be repetitive in the entire display area of the display panel 100.

Referring to FIG. 2, the display panel 100 includes a first pixel H1 and L1, a second pixel H2 and L2 adjacent to the first pixel H1 and L1 in the first direction D1, a third pixel H3 and L3 adjacent to the first pixel H1 and L1 in the second direction D2, and a fourth pixel H4 and L4 adjacent to the third pixel H3 and L3 in the first direction D1.

Each pixel includes a first subpixel and a second subpixel. The first subpixel may be the high pixel H1, H2, H3 and H4. The second subpixel may be the low pixel L1, L2, L3, and L4.

The high pixel H1 of the first pixel includes a high pixel electrode PH1, a first switching element TFTH11, and a second switching element TFTH12. The first switching element TFTH11 applies a data voltage to the high pixel electrode PH1. The second switching element TFTH12 applies a boosting voltage to the high pixel electrode PH1. A high pixel liquid crystal capacitor CLCH1 is formed between the high pixel electrode PH1 and a common electrode to which a common voltage VCOM is applied.

The first switching element TFTH11 includes a source electrode connected to a first data line DL1, which provides the data voltage, a gate electrode connected to a first gate line GL1 and a drain electrode connected to the high pixel electrode PH1.

The second switching element TFTH12 includes a source electrode connected to a first boosting line BL1 providing the boosting voltage, a gate electrode connected to the first gate line GL1 and a drain electrode connected to the high pixel electrode PH1.

The first boosting line BL1 extends in a direction substantially parallel to the first gate line GL1.

Referring to FIG. 4, the first boosting line BL1 and the first gate line GL1 may be disposed directly on the same layer as each other. Alternatively, the first boosting line BL1 and the first gate line GL1 may be disposed directly on different layers from each other.

The low pixel L1 of the first pixel includes a low pixel electrode PL1 and a third switching element TFTL1. The third switching element TFTL1 applies the data voltage to the low pixel electrode PL1. A low pixel liquid crystal capacitor CLCL1 is formed between the low pixel electrode PL1 and the common electrode to which the common voltage VCOM is applied.

The third switching element TFTL1 includes a source electrode connected to the first data line DL1, a gate electrode connected to the first gate line GL1, and a drain electrode connected to the low pixel electrode PL1.

A size of the high pixel H1 may be less than a size of the low pixel L1. A size of the high pixel electrode PH1 may be less than a size of the low pixel electrode PL1. For example, a ratio between the size of the high pixel and the size of the low pixel may be about 1:2.

Alternatively, the size of the high pixel H1 may be substantially the same as the size of the low pixel L1. The size of the high pixel electrode PH1 may be substantially the same as the size of the low pixel electrode PL1.

The boosting voltage may have a polarity substantially the same as a polarity of the data voltage with respect to the common voltage VCOM. For example, the boosting voltage may be a direct current ("DC") voltage having a uniform level in a frame. When the display panel 100 is not driven in a voltage inversion driving method, the boosting voltage may have a DC voltage having a uniform level regardless of time.

The boosting voltage may have a level corresponding to a relatively high grayscale. For example, the boosting voltage may have a level corresponding to a grayscale greater than a medium grayscale. For example, the boosting voltage may have a level corresponding to a maximum grayscale.

When the display panel 100 is driven in a voltage inversion driving method, the data voltage and the boosting voltage may be inverted in each frame.

Referring to FIG. 3, when a gate ON signal is applied to the first gate line GL1, the first switching element TFTH11 and the second switching element TFTH12 function as resistors.

The data voltage VD provided by the first data line DL1 is voltage-divided by a resistance RH of the first switching element TFTH11 and a resistance RB of the second switching element TFTH12 so that the divided data voltage VD is applied to the high pixel electrode PH1.

The boosting voltage VB provided by the first boosting line BL1 is voltage-divided by the resistance RB of the second switching element TFTH12 and the resistance RH of the first switching element TFTH11 so that the divided boosting voltage VB is applied to the high pixel electrode PH1.

A high pixel voltage VH applied to the high pixel electrode PH1 may be determined by using Equation 1.

$$VH = \frac{RB}{RB + RH} \times VD + \frac{RH}{RB + RH} \times VB \qquad \text{[Equation 1]}$$

The resistance RH of the first switching element TFTH11 may be less than the resistance RB of the second switching element TFTH12. For example, to accomplish the difference in resistances, a width to length (W/L) ratio of a channel of the first switching element TFTH11 may be greater than a width to length (W/L) ratio of a channel of the second switching element TFTH12.

The high pixel voltage VH applied to the high pixel electrode PH1 is determined as a sum of a data voltage contribution and a boosting voltage contribution. The high pixel voltage VH applied to the high pixel electrode PH1 is greater than or equal to a low pixel voltage applied to the low pixel electrode PL1.

For example, when RB:RH is 4:1, VD is 15V, and VB is 15V, the high pixel voltage VH is 15V and the low pixel voltage is 15V. For example, when RB:RH is 4:1, VD is 10V, and VB is 15V, the high pixel voltage VH is 11V and the low pixel voltage is 10V. For example, when RB:RH is 4:1, VD is 5V, and VB is 15V, the high pixel voltage VH is 7V and the low pixel voltage is 5V.

When the common voltage VCOM of the display panel 100 is 5V, a difference between the high pixel voltage VH and the low pixel voltage is relatively large in a low grayscale area, but a difference between the high pixel voltage VH and the low pixel voltage is relatively small in a high grayscale area.

The high pixel H2 of the second pixel includes a high pixel electrode PH2, a first switching element TFTH21, and a second switching element TFTH22. The first switching element TFTH21 applies a data voltage to the high pixel electrode PH2. The second switching element TFTH22 applies a boosting voltage to the high pixel electrode PH2. A high pixel liquid crystal capacitor CLCH2 is formed between the high pixel electrode PH2 and the common electrode to which the common voltage VCOM is applied.

A polarity of the second pixel H2 and L2 may be opposite to a polarity of the first pixel H1 and L1. For example, a data voltage applied to the second pixel H2 and L2 may have a polarity opposite to a polarity of the data voltage applied to the first pixel H1 and L1 with respect to the common voltage VCOM. A boosting voltage applied to the high pixel H2 of the second pixel may have a polarity opposite to a polarity of the boosting voltage applied to the high pixel H1 of the first pixel with respect to the common voltage VCOM.

The boosting voltage applied to the high pixel H2 of the second pixel may have an absolute value substantially same as an absolute value of the boosting voltage applied to the high pixel H1 of the first pixel. For example, when the common voltage VCOM is 7.5V, the first pixel may have a positive polarity and the boosting voltage of 15V while the second pixel may have a boosting voltage of 0V.

The boosting voltage applied to the high pixel H2 of the second pixel may have an absolute value different from an absolute value of the boosting voltage applied to the high pixel H1 of the first pixel. A boosting voltage for the positive pixel and a boosting voltage for the negative pixel may be respectively adjusted so that the boosting voltages may be optimized to a characteristic of the switching element according to the polarities. Thus, a display defect of the display panel 100 such as a flicker and an afterimage may be prevented and a reliability of the switching element may be improved.

As explained above, when the display panel 100 is driven in a voltage inversion driving method, the data voltage and the boosting voltage may be inverted in each frame. For example, during a first frame, the data voltage and the boosting voltage applied to the first pixel H1 and L1 may have a positive polarity with respect to the common voltage VCOM and the data voltage and the boosting voltage applied to the second pixel H2 and L2 may have a negative polarity with respect to the common voltage VCOM. In contrast, during a second frame, the data voltage and the boosting voltage applied to the first pixel H1 and L1 may have a negative polarity with respect to the common voltage VCOM and the data voltage and the boosting voltage applied to the second pixel H2 and L2 may have a positive polarity with respect to the common voltage VCOM.

The first switching element TFTH21 includes a source electrode connected to a second data line DL2, which provides the data voltage, a gate electrode connected to the first gate line GL1 and a drain electrode connected to the high pixel electrode PH2.

The second switching element TFTH22 includes a source electrode connected to a second boosting line BL2, which provides the boosting voltage, a gate electrode connected to the first gate line GL1 and a drain electrode connected to the high pixel electrode PH2.

The second boosting line BL2 extends in a direction substantially parallel to the first gate line GL1.

Referring to FIG. 4, the second boosting line BL2 and the first gate line GL1 may be disposed directly on the same layer as each other. Alternatively, the second boosting line BL2 and the first gate line GL1 may be disposed directly on different layers from each other.

The low pixel L2 of the second pixel includes a low pixel electrode PL2 and a third switching element TFTL2. The third switching element TFTL2 applies the data voltage to the low pixel electrode PL2. A low pixel liquid crystal capacitor CLCL2 is formed between the low pixel electrode PL2 and the common electrode to which the common voltage VCOM is applied.

The third switching element TFTL2 includes a source electrode connected to the second data line DL2, a gate electrode connected to the first gate line GL1, and a drain electrode connected to the low pixel electrode PL2.

The high pixel H3 of the third pixel includes a high pixel electrode PH3, a first switching element TFTH31, and a second switching element TFTH32. The first switching element TFTH31 applies a data voltage to the high pixel electrode PH3. The second switching element TFTH32 applies a boosting voltage to the high pixel electrode PH3. A high pixel liquid crystal capacitor CLCH3 is formed between the high pixel electrode PH3 and the common electrode to which the common voltage VCOM is applied.

A polarity of the third pixel H3 and L3 may be opposite to a polarity of the first pixel H1 and L1. A data voltage applied to the third pixel H3 and L3 may have a polarity opposite to a polarity of the data voltage applied to the first pixel H1 and L1 with respect to the common voltage VCOM. A boosting voltage applied to the high pixel H3 of the third pixel may have a polarity opposite to a polarity of the boosting voltage applied to the high pixel H1 of the first pixel with respect to the common voltage VCOM.

The first switching element TFTH31 includes a source electrode connected to the second data line DL2, which provides the data voltage, a gate electrode connected to a second gate line GL2, and a drain electrode connected to the high pixel electrode PH3.

The second switching element TFTH32 includes a source electrode connected to a fourth boosting line BL4, which provides the boosting voltage, a gate electrode connected to the second gate line GL2, and a drain electrode connected to the high pixel electrode PH3.

The fourth boosting line BL4 extends in a direction substantially parallel to the second gate line GL2. The fourth boosting line BL4 and the second gate line GL2 may be disposed directly on the same layer as each other, or the fourth boosting line BL4 and the second gate line GL2 may be disposed directly on different layers from each other.

The fourth boosting line BL4 may be connected to the second boosting line BL2. For example, the fourth boosting line BL4 may be connected to the second boosting line BL2 outside a display region of the display panel 100. Alternatively, the fourth boosting line BL4 may be connected to the second boosting line BL2 through at least one of boosting connecting lines BCL1, BCL2, BCL3, BCL4 (not shown) etc. in the display region. The boosting connecting line BCL1 to BCL3 may overlap the data line DL1 to DL3. The boosting connecting line BCL1 to BCL3 may extend in a direction parallel to the data line DL1 to DL3.

Referring to FIG. 5, the boosting connecting line BCL1 to BCL3 may be disposed directly on the same layer as the high pixel electrode PH1 and PH4 and the low pixel electrode PL1 to PL4. A width of the boosting connecting line BCL1 to BCL3 may be less than a width of the data line DL1 to DL3. The boosting connecting lines BCL1 to BCL3 may be insulated from the data lines DL1 to DL3 by an insulating layer.

The low pixel L3 of the third pixel includes a low pixel electrode PL3 and a third switching element TFTL3. The third switching element TFTL3 applies the data voltage to the low pixel electrode PL3. A low pixel liquid crystal capacitor CLCL3 is formed between the low pixel electrode PL3 and the common electrode to which the common voltage VCOM is applied.

The third switching element TFTL3 includes a source electrode connected to the second data line DL2, a gate electrode connected to the second gate line GL2, and a drain electrode connected to the low pixel electrode PL3.

The high pixel H4 of the fourth pixel includes a high pixel electrode PH4, a first switching element TFTH41, and a second switching element TFTH42. The first switching element TFTH41 applies a data voltage to the high pixel electrode PH4. The second switching element TFTH42 applies a boosting voltage to the high pixel electrode PH4. A high pixel liquid crystal capacitor CLCH4 is formed between the high pixel electrode PH4 and the common electrode to which the common voltage VCOM is applied.

A polarity of the fourth pixel H4 and L4 may be substantially same as a polarity of the first pixel H1 and L1. A data voltage applied to the fourth pixel H4 and L4 may have a polarity substantially the same as a polarity of the data voltage applied to the first pixel H1 and L1 with respect to the common voltage VCOM. A boosting voltage applied to the high pixel H4 of the fourth pixel may be substantially the same as the boosting voltage applied to the high pixel H1 of the first pixel.

The first switching element TFTH41 includes a source electrode connected to a third data line DL3, which provides the data voltage, a gate electrode connected to the second gate line GL2 and a drain electrode connected to the high pixel electrode PH4.

The second switching element TFTH42 includes a source electrode connected to a third boosting line BL3 providing the boosting voltage, a gate electrode connected to the second gate line GL2 and a drain electrode connected to the high pixel electrode PH4.

The third boosting line BL3 extends in a direction substantially parallel to the second gate line GL2. The third boosting line BL3 and the second gate line GL2 may be disposed directly on the same layer as each other, or the third boosting line BL3 and the second gate line GL2 may be disposed directly on different layers from each other.

The third boosting line BL3 may be connected to the first boosting line BL1. The third boosting line BL3 may be connected to the first boosting line BL1 outside the display region of the display panel 100. Alternatively, as described above, the third boosting line BL3 may be connected to the first boosting line BL1 through at least one of the boosting connecting lines BCL1, BCL2, BCL3, etc. in the display region. The boosting connecting line BCL1 to BCL3 may overlap the data line DL1 to DL3.

The low pixel L4 of the fourth pixel includes a low pixel electrode PL4 and a third switching element TFTL4. The third switching element TFTL4 applies the data voltage to the low pixel electrode PL4. A low pixel liquid crystal capacitor CLCL4 is formed between the low pixel electrode PL4 and the common electrode to which the common voltage VCOM is applied.

The third switching element TFTL4 includes a source electrode connected to the third data line DL3, a gate electrode connected to the second gate line GL2, and a drain electrode connected to the low pixel electrode PL4.

Figure 6:
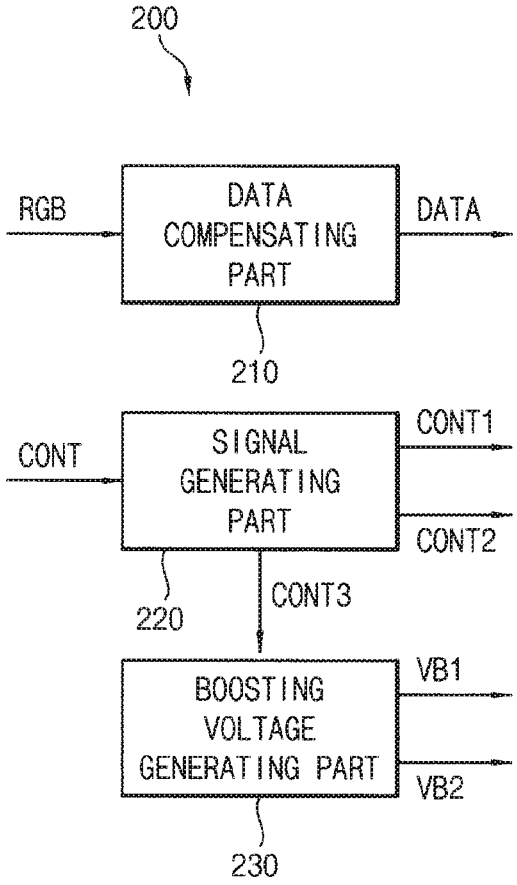
FIG. 6 is a block diagram illustrating a timing controller of FIG. 1.

FIG. 6 is a block diagram illustrating the timing controller 200 of FIG. 1.

Referring to FIG. 6, the timing controller 200 includes a data compensating part 210, a signal generating part 220 and a boosting voltage generating part 230. The elements of the timing controller 200 are not physically divided, but logically divided for convenience of the explanation.

The data compensating part 210 receives the input image data RGB from, for example, an external apparatus. The data compensating part 210 compensates the input image data RGB to generate the data signal DATA.

The data compensating part 210 may include an adaptive color correcting part (not shown) and a dynamic capacitance compensating part (not shown).

The adaptive color correcting part receives the input image data RGB and operates an adaptive color correction ("ACC"). The adaptive color correcting part may compensate the grayscale data using a gamma curve.

The dynamic capacitance compensating part operates a dynamic capacitance compensation ("DCC"), which compensates the grayscale data of present frame data using previous frame data and the present frame data.

The signal generating part 220 generates the first control signal CONT1, based on the input control signal CONT, and outputs the first control signal CONT1 to the gate driver 300. The signal generating part 220 generates the second control signal CONT2, based on the input control signal CONT, and outputs the second control signal CONT2 to the data driver 500. The signal generating part 220 generates the third control signal CONT3, based on the input control signal CONT, and outputs the third control signal CONT3 to the boosting voltage generating part 230. The third control signal CONT3 may include an inverting signal.

The boosting voltage generating part 230 generates the first boosting voltage VB1 and the second boosting voltage VB2 based on the third control signal CONT3. The boosting voltage generating part 230 outputs the first and second boosting voltages VB1 and VB2 to the display panel 100. For example, the boosting voltage generating part 230 outputs the first and second boosting voltages VB1 and VB2 to the boosting connecting line BCL1 to BCL3. In one exemplary embodiment, the first boosting voltage VB1 may be supplied to the odd boosting connecting lines BCL1, BCL3, etc., and the second boosting voltage VB2 may be supplied to the even boosting connecting lines BCL2, BCL4 (not shown), etc.

The first boosting voltage VB1 and the second boosting voltage VB2 may have a uniform level in a single frame. In the single frame, one of the first and second boosting voltages VB1 and VB2 is greater than the common voltage VCOM and the other is less than the common voltage VCOM.

The polarities of the first boosting voltage VB1 and the second boosting voltage VB2 may be inverted in each frame. The second boosting voltage VB2 may be generated by inverting a polarity of the first boosting voltage VB1.

The first boosting voltage VB1 may be applied to the first boosting line BL1, the third boosting line BL3 and so on. The second boosting voltage VB2 may be applied to the second boosting line BL2, the fourth boosting line BL4 (not shown) and so on.

Figure 7:
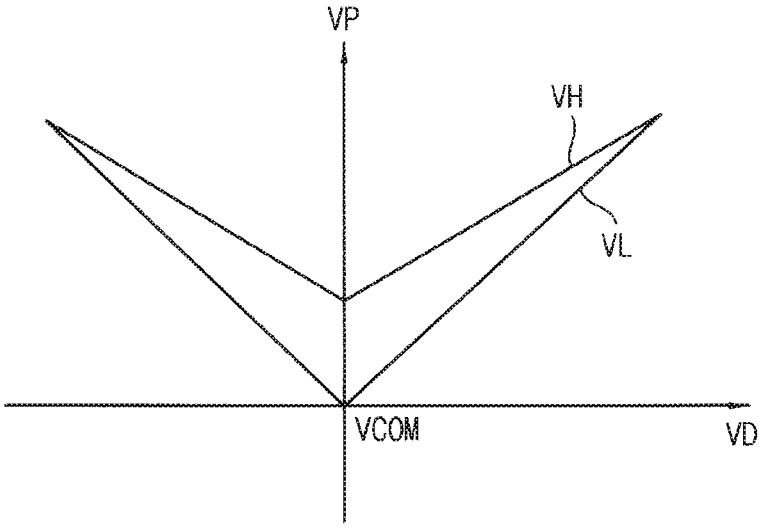
FIG. 7 is a graph illustrating pixel voltages charged at a high pixel and a low pixel of FIG. 2 according to a data voltage.
Figure 8:
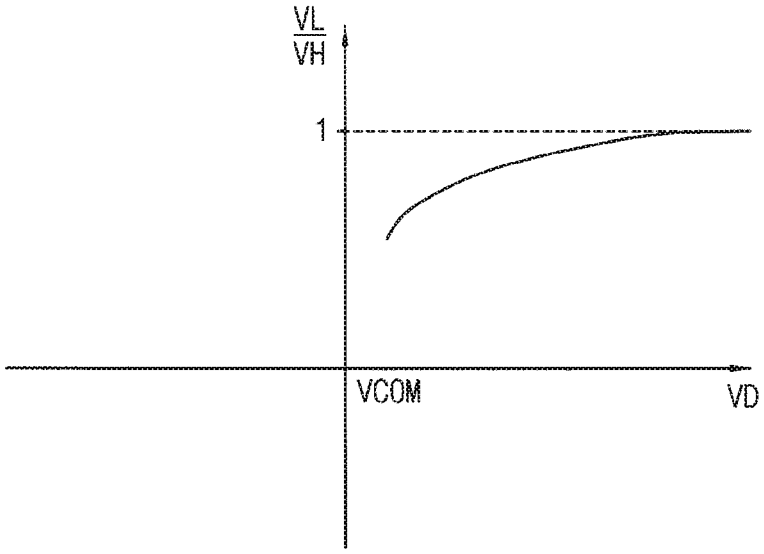
FIG. 8 is a graph illustrating a ratio between the pixel voltages charged at the high pixel and the pixel voltage charged at the low pixel of FIG. 2 according to a data voltage.

FIG. 7 is a graph illustrating pixel voltages charged at a high pixel and a low pixel of FIG. 2 according to a data voltage. FIG. 8 is a graph illustrating a ratio between the pixel voltages charged at the high pixel and the pixel voltage charged at the low pixel of FIG. 2 according to a data voltage.

Referring to FIGS. 2, 3, 7 and 8, the data voltage VD is applied to the low pixel electrode PL1 to PL4 through the third switching element TFTL1 to TFTL4, respectively. A low pixel voltage VL applied to the low pixel electrode PL1 to PL4 is substantially the same as the data voltage VD.

The data voltage VD is applied to the high pixel electrode PH1 to PH4 through the first switching element TFTH11, TFTH21, TFTH31 and TFTH41, respectively. In addition, the boosting voltage VB is applied to the high pixel electrode PH1 to PH4 through the second switching element TFTH12, TFTH22, TFTH32 and TFTH42, respectively. A high pixel voltage VH applied to the high pixel electrode PH1 to PH4 may be determined as a sum of the data voltage contribution VD and the boosting voltage contribution VB using Equation 1 above. The high pixel voltage VH may be equal to or greater than the data voltage VD.

Thus, the high pixel voltage VH may be equal to or greater than the low pixel voltage VL. A ratio of the low pixel voltage VL to the high pixel voltage VH is low in a relatively low grayscale area. The ratio of the low pixel voltage VL to the high pixel voltage VH increases as the grayscale increases. The low pixel voltage VL is substantially equal to the high pixel voltage VH in a maximum grayscale area. The ratio of the low pixel voltage VL to the high pixel voltage VH is substantially 1 in the maximum grayscale area.

In the relatively low grayscale area, a difference between the high pixel voltage VH and the low pixel voltage VL is relatively high, so that a side visibility of the display panel 100 may be improved. In addition, in the relatively high grayscale area, a difference between the high pixel voltage VH and the low pixel voltage VL is relatively low, so that a light transmittance of the display panel 100 may be improved.

In addition, the voltage applied to the high pixel is boosted using the boosting voltage so that a response time of the display panel 100 may decrease.

The graph of FIG. 7 has a symmetrical shape with respect to the common voltage VCOM in a lateral direction. Respectively using the positive boosting voltage and the negative boosting voltage, a characteristic of the switching element may be adjusted not to be changed according to the polarity of the data voltage VD.

Thus, display defects such as a flicker and afterimage due to the difference of characteristics of the switching element according to the polarities may be prevented. The reliability of the switching element may be improved.

According to the present exemplary embodiment, the side visibility and the light transmittance of the display panel 100 may be improved. Display defects such as flicker and afterimage may be prevented so that a display quality of the display panel 100 may be improved. In addition, the reliability of the switching element is improved so that the reliability of the display panel 100 may be improved.

Figure 9:
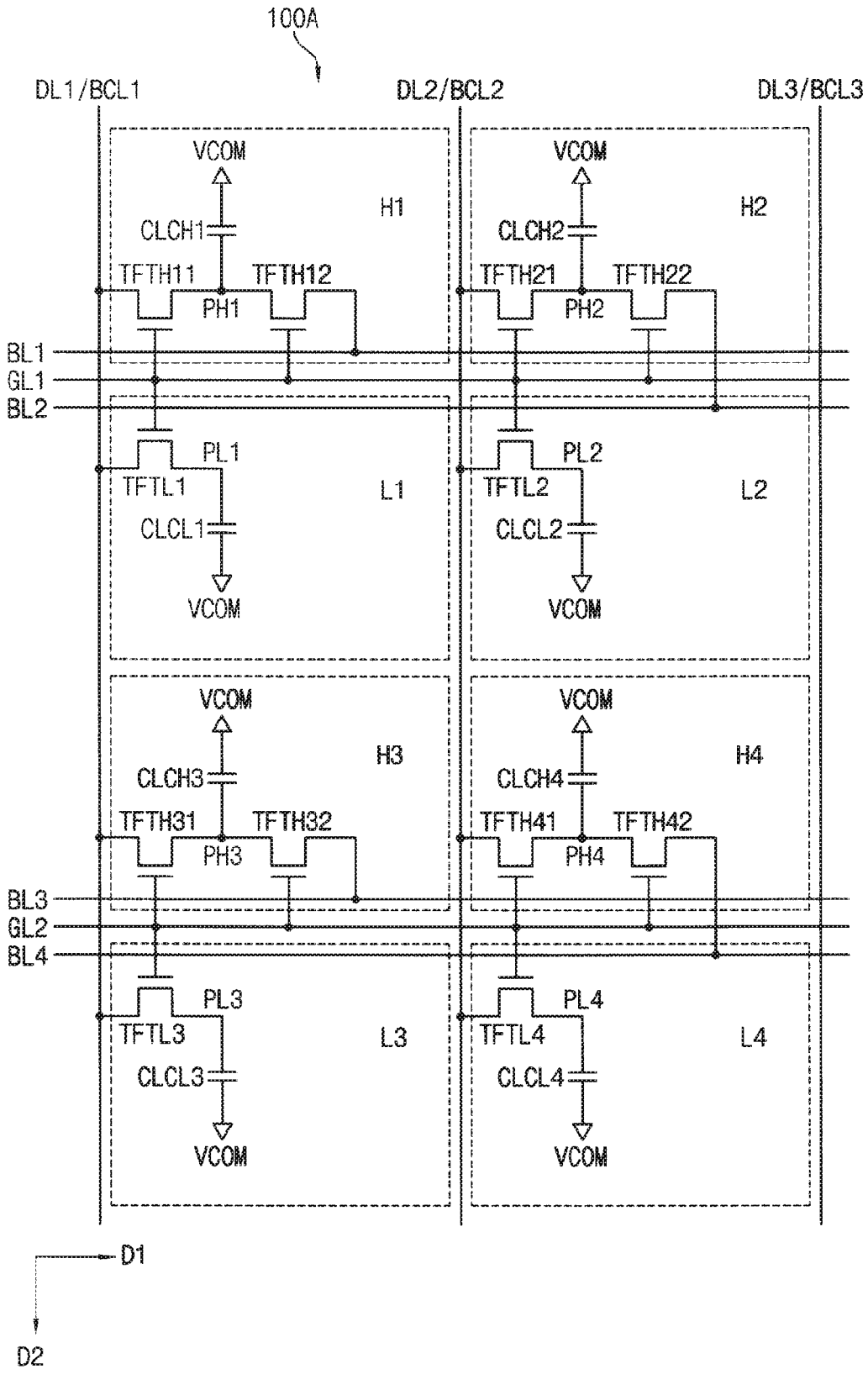
FIG. 9 is a circuit diagram illustrating a pixel structure of a display panel according to another exemplary embodiment of the present invention.

FIG. 9 is a circuit diagram illustrating a pixel structure of a display panel according to another exemplary embodiment of the present invention.

The display apparatus according to the present exemplary embodiment is substantially the same as the display apparatus of the previous exemplary embodiment explained referring to FIGS. 1 to 8 except for the pixel structure of a display panel and the way pixels in the display are connected to the data lines and the boosting lines. Thus, the same reference numerals will be used to refer to the same or like parts as those described in the previous exemplary embodiment of FIGS. 1 to 8 and any repetitive explanation concerning the above elements will be omitted.

Referring to FIGS. 1 and 9, the display apparatus includes a display panel 100A, a timing controller 200, a gate driver 300, a gamma reference voltage generator 400, and a data driver 500.

Although four pixels are represented in FIG. 9, FIG. 9 does not represent an entire display panel 100A but a portion of the display panel 100A. The pixel structure in FIG. 9 may be repetitive in an entire area of the display panel 100A.

The display panel 100A includes a first pixel H1 and L1, a second pixel H2 and L2 adjacent to the first pixel H1 and L1 in the first direction D1, a third pixel H3 and L3 adjacent to the first pixel H1 and L1 in the second direction D2, and a fourth pixel H4 and L4 adjacent to the third pixel H3 and L3 in the first direction D1.

Each pixel includes a first subpixel and a second subpixel. The first subpixel may be the high pixel H1, H2, H3, and H4. The second subpixel may be the low pixel L1, L2, L3, and L4.

The high pixel H1 of the first pixel includes a high pixel electrode PH1, a first switching element TFTH11, and a second switching element TFTH12. The first switching element TFTH11 applies a data voltage to the high pixel electrode PH1. The second switching element TFTH12 applies a boosting voltage to the high pixel electrode PH1. A high pixel liquid crystal capacitor CLCH1 is formed between the high pixel electrode PH1 and a common electrode to which a common voltage VCOM is applied.

The first switching element TFTH11 includes a source electrode connected to a first data line DL1, which provides the data voltage, a gate electrode connected to a first gate line GL1 and a drain electrode connected to the high pixel electrode PH1.

The second switching element TFTH12 includes a source electrode connected to a first boosting line BL1, which provides the boosting voltage, a gate electrode connected to the first gate line GL1 and a drain electrode connected to the high pixel electrode PH1.

The first boosting line BL1 extends in a direction substantially parallel to the first gate line GL1. The first boosting line BL1 and the first gate line GL1 may be disposed directly on the same layer as each other, or the first boosting line BL1 and the first gate line GL1 may be disposed directly on different layers from each other.

The low pixel L1 of the first pixel includes a low pixel electrode PL1 and a third switching element TFTL1. The third switching element TFTL1 applies the data voltage to the low pixel electrode PL1. A low pixel liquid crystal capacitor CLCL1 is formed between the low pixel electrode PL1 and the common electrode to which the common voltage VCOM is applied.

The third switching element TFTL1 includes a source electrode connected to the first data line DL1, a gate electrode connected to the first gate line GL1, and a drain electrode connected to the low pixel electrode PL1.

A size of the high pixel H1 may be less than a size of the low pixel L1. A size of the high pixel electrode PH1 may be less than a size of the low pixel electrode PL1. Alternatively, the size of the high pixel H1 may be substantially the same as the size of the low pixel L1. The size of the high pixel electrode PH1 may be substantially the same as the size of the low pixel electrode PL1.

The boosting voltage may have a polarity that is substantially the same as a polarity of the data voltage with respect to the common voltage VCOM. For example, the boosting voltage may be a direct current ("DC") voltage having a uniform level in a frame. When the display panel 100A is not driven in a voltage inversion driving method, the boosting voltage may have a DC voltage having a uniform level regardless of time.

The boosting voltage may have a level corresponding to a relatively high grayscale. For example, the boosting voltage may have a level corresponding to a grayscale greater than a medium grayscale. For example, the boosting voltage may have a level corresponding to a maximum grayscale.

When the display panel 100A is driven in a voltage inversion driving method, the data voltage and the boosting voltage may be inverted in each frame.

The high pixel H2 of the second pixel includes a high pixel electrode PH2, a first switching element TFTH21, and a second switching element TFTH22. The first switching element TFTH21 applies a data voltage to the high pixel electrode PH2. The second switching element TFTH22 applies a boosting voltage to the high pixel electrode PH2. A high pixel liquid crystal capacitor CLCH2 is formed between the high pixel electrode PH2 and the common electrode to which the common voltage VCOM is applied.

A polarity of the second pixel H2 and L2 may be opposite to a polarity of the first pixel H1 and L1. For example, a data voltage applied to the second pixel H2 and L2 may have a polarity opposite to a polarity of the data voltage applied to the first pixel H1 and L1 with respect to the common voltage VCOM. A boosting voltage applied to the high pixel H2 of the second pixel may have a polarity opposite to a polarity of the boosting voltage applied to the high pixel H1 of the first pixel with respect to the common voltage VCOM.

The boosting voltage applied to the high pixel H2 of the second pixel may have an absolute value substantially same as an absolute value of the boosting voltage applied to the high pixel H1 of the first pixel. For example, when the common voltage VCOM is 7.5V, the first pixel may have a positive polarity and a boosting voltage of 15V while the second pixel may have a boosting voltage of 0V.

The boosting voltage applied to the high pixel H2 of the second pixel may have an absolute value different from an absolute value of the boosting voltage applied to the high pixel H1 of the first pixel. A boosting voltage for the positive pixel and a boosting voltage for the negative pixel may be respectively adjusted so that the boosting voltages may be optimized to a characteristic of the switching element according to the polarities. Thus, a display defect of the display panel 100 such as a flicker and an afterimage may be prevented and a reliability of the switching element may be improved.

The first switching element TFTH21 includes a source electrode connected to a second data line DL2, which provides the data voltage, a gate electrode connected to the first gate line GL1 and a drain electrode connected to the high pixel electrode PH2.

The second switching element TFTH22 includes a source electrode connected to a second boosting line BL2, which provides the boosting voltage, a gate electrode connected to the first gate line GL1 and a drain electrode connected to the high pixel electrode PH2.

The second boosting line BL2 extends in a direction substantially parallel to the first gate line GL1. The second boosting line BL2 and the first gate line GL1 may be disposed directly on the same layer as each other, or the second boosting line BL2 and the first gate line GL1 may be disposed directly on different layers from each other.

The low pixel L2 of the second pixel includes a low pixel electrode PL2 and a third switching element TFTL2. The third switching element TFTL2 applies the data voltage to the low pixel electrode PL2. A low pixel liquid crystal capacitor CLCL2 is formed between the low pixel electrode PL2 and the common electrode to which the common voltage VCOM is applied.

The third switching element TFTL2 includes a source electrode connected to the second data line DL2, a gate electrode connected to the first gate line GL1, and a drain electrode connected to the low pixel electrode PL2.

The high pixel H3 of the third pixel includes a high pixel electrode PH3, a first switching element TFTH31, and a second switching element TFTH32. The first switching element TFTH31 applies a data voltage to the high pixel electrode PH3. The second switching element TFTH32 applies a boosting voltage to the high pixel electrode PH3. A high pixel liquid crystal capacitor CLCH3 is formed between the high pixel electrode PH3 and the common electrode to which the common voltage VCOM is applied.

A polarity of the third pixel H3 and L3 may be substantially same as a polarity of the first pixel H1 and L1. A data voltage applied to the third pixel H3 and L3 may have a polarity substantially same as a polarity of the data voltage applied to the first pixel H1 and L1 with respect to the common voltage VCOM. A boosting voltage applied to the high pixel H3 of the third pixel may be substantially same as the boosting voltage applied to the high pixel H1 of the first pixel.

The first switching element TFTH31 includes a source electrode connected to the first data line DL1, which provides the data voltage, a gate electrode connected to a second gate line GL2, and a drain electrode connected to the high pixel electrode PH3.

The second switching element TFTH32 includes a source electrode connected to a third boosting line BL3, which provides the boosting voltage, a gate electrode connected to the second gate line GL2, and a drain electrode connected to the high pixel electrode PH3.

The third boosting line BL3 extends in a direction substantially parallel to the second gate line GL2. The third boosting line BL3 and the second gate line GL2 may be disposed directly on the same layer as each other, or the third boosting line BL3 and the second gate line GL2 may be disposed directly on different layers from each other.

The low pixel L3 of the third pixel includes a low pixel electrode PL3 and a third switching element TFTL3. The third switching element TFTL3 applies the data voltage to the low pixel electrode PL3. A low pixel liquid crystal capacitor CLCL3 is formed between the low pixel electrode PL3 and the common electrode to which the common voltage VCOM is applied.

The third switching element TFTL3 includes a source electrode connected to the first data line DL1, a gate electrode connected to the second gate line GL2, and a drain electrode connected to the low pixel electrode PL3.

The high pixel H4 of the fourth pixel includes a high pixel electrode PH4, a first switching element TFTH41, and a second switching element TFTH42. The first switching element TFTH41 applies a data voltage to the high pixel electrode PH4. The second switching element TFTH42 applies a boosting voltage to the high pixel electrode PH4. A high pixel liquid crystal capacitor CLCH4 is formed between the high pixel electrode PH4 and the common electrode to which the common voltage VCOM is applied.

A polarity of the fourth pixel H4 and L4 may be substantially the same as the polarity of the second pixel H2 and L2. A data voltage applied to the fourth pixel H4 and L4 may have a polarity substantially the same as the polarity of the data voltage applied to the second pixel H2 and L2 with respect to the common voltage VCOM. A boosting voltage applied to the high pixel H4 of the fourth pixel may be substantially the same as the boosting voltage applied to the high pixel H2 of the second pixel.

The first switching element TFTH41 includes a source electrode connected to the second data line DL2, which provides the data voltage, a gate electrode connected to the second gate line GL2, and a drain electrode connected to the high pixel electrode PH4.

The second switching element TFTH42 includes a source electrode connected to a fourth boosting line BL4, which provides the boosting voltage, a gate electrode connected to the second gate line GL2, and a drain electrode connected to the high pixel electrode PH4.

The fourth boosting line BL4 extends in a direction substantially parallel to the second gate line GL2. The fourth boosting line BL4 and the second gate line GL2 may be disposed directly on the same layer as each other, or the fourth boosting line BL4 and the second gate line GL2 may be disposed directly on different layers from each other.

The low pixel L4 of the fourth pixel includes a low pixel electrode PL4 and a third switching element TFTL4. The third switching element TFTL4 applies the data voltage to the low pixel electrode PL4. A low pixel liquid crystal capacitor CLCL4 is formed between the low pixel electrode PL4 and the common electrode to which the common voltage VCOM is applied.

The third switching element TFTL4 includes a source electrode connected to the second data line DL2, a gate electrode connected to the second gate line GL2, and a drain electrode connected to the low pixel electrode PL4.

According to the present exemplary embodiment, the side visibility and the light transmittance of the display panel 100A may be improved. Display defects such as flicker and afterimage may be prevented so that a display quality of the display panel 100A may be improved. In addition, the reliability of the switching element is improved so that the reliability of the display panel 100A may be improved.

Figure 10:
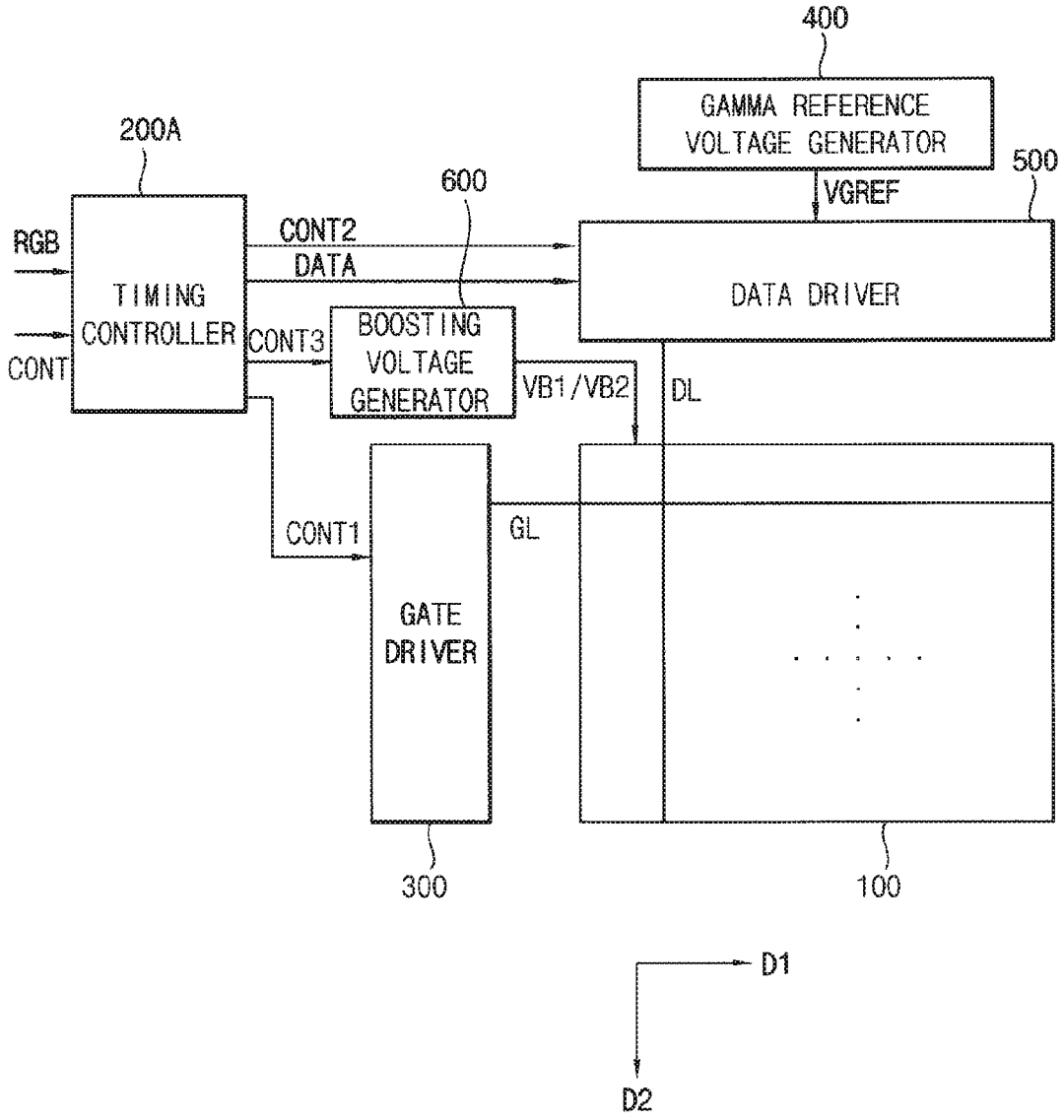
FIG. 10 is a block diagram illustrating a display apparatus according to still another exemplary embodiment of the present invention.

FIG. 10 is a block diagram illustrating a display apparatus according to still another exemplary embodiment of the present invention.

The display apparatus according to the present exemplary embodiment is substantially the same as the display apparatus of the previous exemplary embodiment explained referring to FIGS. 1 to 8 except for a timing controller and a boosting voltage generator. Thus, the same reference numerals will be used to refer to the same or like parts as those described in the previous exemplary embodiment of FIGS. 1 to 8 and any repetitive explanation concerning the above elements will be omitted.

Referring to FIG. 10, the display apparatus includes a display panel 100, a timing controller 200, a gate driver 300, a gamma reference voltage generator 400, a data driver 500 and a boosting voltage generator 600.

The display panel 100 may include, for example, a plurality of gate lines GL, a plurality of data lines DL and a plurality of pixels connected to the gate lines GL and the data lines DL. The gate lines GL extend in a first direction D1 and the data lines DL extend in a second direction D2 crossing the first direction D1. The pixels may be disposed in a matrix form. Each pixel includes a first subpixel and a second subpixel.

The timing controller 200 receives input image data RGB and an input control signal CONT from an external apparatus (not shown). The input image data may include red image data R, green image data G, and blue image data B. The input control signal CONT includes a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling an operation of the boosting voltage generator 600 based on the input control signal CONT, and outputs the third control signal CONT3 to the boosting voltage generator 600. The third control signal CONT3 may include an inverting signal.

The gate driver 300 generates gate signals driving the gate lines GL in response to the first control signal CONT1 received from the timing controller 200. The gate driver 300 sequentially outputs the gate signals to the gate lines GL.

The gamma reference voltage generator 400 generates a gamma reference voltage VGREF and provides the gamma reference voltage VGREF to the data driver 500. The gamma reference voltage VGREF has a value corresponding to a level of the data signal DATA.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 sequentially outputs the data voltages to the data lines DL.

The boosting voltage generator 600 generates a first boosting voltage VB1 and a second boosting voltage VB2 based on the third control signal CONT3. The boosting voltage generator 600 outputs the first and second boosting voltages VB1 and VB2 to the display panel 100.

The first boosting voltage VB1 and the second boosting voltage VB2 may have a uniform level in a single frame. The polarities of the first boosting voltage VB1 and the second boosting voltage VB2 may be inverted in each frame. The second boosting voltage VB2 may be generated by inverting a polarity of the first boosting voltage VB1.

According to the present exemplary embodiment, the side visibility and the light transmittance of the display panel 100 may be improved. Display defects such as flicker and afterimage may be prevented so that the display quality of the display panel 100 may be improved. In addition, the reliability of the switching element is improved so that the reliability of the display panel 100 may be improved.

According to the present invention as explained above, the side visibility and the light transmittance of the display panel may be improved. Display defects such as flicker and afterimage may be prevented. The reliability of the switching element may be improved. Thus, the display quality and reliability of the display panel may be improved.

In the claims, means-plus-function clauses are intended to cover the structures described herein as performing the recited function and not only structural equivalents but also equivalent structures.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display panel comprising:

a plurality of pixels, a first pixel among the plurality of pixels comprising a first subpixel and a second subpixel;

the first subpixel comprising a first subpixel electrode, a first switching element configured to apply a data voltage to the first subpixel electrode and a second switching element configured to apply a boosting voltage to the first subpixel electrode; and the second subpixel comprising a second subpixel electrode and a third switching element configured to apply the data voltage to the second subpixel electrode, wherein:

the first switching element comprises a source electrode connected to a first data line configured to provide the data voltage, a gate electrode connected to a first gate line, and a drain electrode connected to the first subpixel electrode;

the second switching element comprises a source electrode connected to a first boosting line configured to provide the boosting voltage, a gate electrode connected to the first gate line, and a drain electrode directly connected to the first subpixel electrode, further comprising a boosting connecting line, wherein the first boosting line is connected to another first boosting line of at least one of other pixels through the boosting connecting line.

2. The display panel of claim 1, wherein a polarity of the boosting voltage is the same as a polarity of the data voltage with respect to a common voltage.

3. The display panel of claim 2, wherein the boosting voltage has a uniform level in a frame.

4. The display panel of claim 3, wherein a level of the boosting voltage corresponds to a grayscale equal to or greater than a medium grayscale.

5. The display panel of claim 4, wherein the level of the boosting voltage corresponds to a maximum grayscale.

6. The display panel of claim 2, wherein the data voltage and the boosting voltage are inverted in each frame.

7. The display panel of claim 1, wherein a size of the first subpixel is equal to or smaller than a size of the second subpixel.

8. The display panel of claim 1, wherein the first switching element and the second switching element are connected to the same gate line.

9. The display panel of claim 1, wherein a width to length ratio of a channel of the first switching element is greater than a width to length ratio of a channel of the second switching element.

10. The display panel of claim 1, wherein the third switching element comprises a source electrode connected to the first data line, a gate electrode connected to the first gate line and a drain electrode connected to the second subpixel electrode.

11. The display panel of claim 1, wherein the first boosting line extends in a direction substantially parallel to the first gate line.

12. The display panel of claim 1, wherein the first boosting line is disposed directly on the same layer as the first gate line.

13. The display panel of claim 1, wherein the boosting connecting line extends in a direction substantially parallel to the first data line, and the boosting connecting line overlaps the first data line.

14. The display panel of claim 1, wherein the boosting connecting line is disposed directly on the same layer as the first subpixel electrode and the second subpixel electrode.

15. The display panel of claim 1, wherein a second pixel among the plurality of pixels comprises:

a first subpixel comprising a first subpixel electrode, a first switching element configured to apply a data voltage to the first subpixel electrode and a second switching element configured to apply a boosting voltage to the first subpixel electrode; and a second subpixel comprising a second subpixel electrode and a third switching element applying the data voltage to the second subpixel electrode, wherein the second pixel is adjacent to the first pixel in a first direction, a polarity of the data voltage of the second pixel is opposite to a polarity of the data voltage of the first pixel with respect to a common voltage, and a polarity of the boosting voltage of the second pixel is opposite to a polarity of the boosting voltage of the first pixel with respect to the common voltage.

16. The display panel of claim 15, wherein the boosting voltage of the second pixel has an absolute value substantially the same as an absolute value of the boosting voltage of the first pixel.

17. The display panel of claim 15, wherein an absolute value of the boosting voltage of the second pixel is different from an absolute value of the boosting voltage of the first pixel.

18. The display panel of claim 15, further comprising a second boosting line, wherein the boosting voltage of the first pixel is applied to the first pixel through the first boosting line, the boosting voltage of the second pixel is applied to the second pixel through the second boosting line, and the first boosting line extends in a direction substantially parallel to the second boosting line.

19. The display panel of claim 15, wherein a third pixel among the plurality of pixels comprises:

a first subpixel comprising a first subpixel electrode, a first switching element configured to apply a data voltage to the first subpixel electrode and a second switching element configured to apply a boosting voltage to the first subpixel electrode; and a second subpixel comprising a second subpixel electrode and a third switching element configured to apply the data voltage to the second subpixel electrode, wherein the third pixel is adjacent to the first pixel in a second direction crossing the first direction, a polarity of the data voltage of the third pixel is opposite to a polarity of the data voltage of the first pixel with respect to the common voltage, and a polarity of the boosting voltage of the third pixel is opposite to a polarity of the boosting voltage of the first pixel with respect to the common voltage.

20. The display panel of claim 15, wherein a third pixel among the plurality of pixels comprises:

a first subpixel comprising a first subpixel electrode, a first switching element configured to apply a data voltage to the first subpixel electrode and a second switching element configured to apply a boosting voltage to the first subpixel electrode; and a second subpixel comprising a second subpixel electrode and a third switching element configured to apply the data voltage to the second subpixel electrode, wherein the third pixel is adjacent to the first pixel in a second direction crossing the first direction, a polarity of the data voltage of the third pixel is the same as a polarity of the data voltage of the first pixel with respect to the common voltage, and a polarity of the boosting voltage of the third pixel is the same as a polarity of the boosting voltage of the first pixel with respect to the common voltage.

* * * * *